US007508122B2

(12) United States Patent
Huber

(10) Patent No.: US 7,508,122 B2
(45) Date of Patent: Mar. 24, 2009

(54) PLANAR GATED FIELD EMISSION DEVICES

(75) Inventor: William Hullinger Huber, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 176 days.

(21) Appl. No.: 11/029,707

(22) Filed: Jan. 5, 2005

(65) Prior Publication Data

US 2006/0145582 A1 Jul. 6, 2006

(51) Int. Cl.
*H01J 1/02* (2006.01)
*H01J 1/62* (2006.01)
*H01J 63/04* (2006.01)

(52) U.S. Cl. ..... 313/309; 313/495; 313/483; 313/496; 313/497

(58) Field of Classification Search ..... 313/309, 313/311, 351, 495
See application file for complete search history.

(56) References Cited

U.S. PATENT DOCUMENTS 6,420,726 B2 7/2002 Choi et al.
7,161,289 B2 * 1/2007 Lee et al. ..... 313/497
7,239,074 B2 * 7/2007 Wei et al. ..... 313/495
2002/0134978 A1 * 9/2002 Kastalsky et al. ..... 257/10
2003/0071257 A1 4/2003 Kang et al.
2004/0061431 A1 * 4/2004 Takeuchi et al. ..... 313/495
2004/0067602 A1 * 4/2004 Jin ..... 438/22

* cited by examiner

*Primary Examiner*—Nimeshkumar D. Patel
*Assistant Examiner*—Natalie K Walford
(74) *Attorney, Agent, or Firm*—Paul J. DiConza

(57) ABSTRACT

In a field emitter (100) including a substrate (110), the substrate (110) has a substantially non-conductive top substrate surface (112). A conductive cathode member (130) is disposed on the top substrate surface (112) and has a top cathode surface (132). A conductive gate member (120) is disposed on the top substrate surface (112) and is substantially coplanar with the cathode member (130). An emitter structure (140) extends away from the top cathode surface (132). The gate member (120) is spaced apart from the cathode member (130) at a distance so that when a predetermined potential is applied between the cathode member (130) and gate member (120), the emitter structure (140) will emit electrons.

14 Claims, 4 Drawing Sheets

PLANAR GATED FIELD EMISSION DEVICES

BACKGROUND

1. Field of the Invention

The invention relates to nano-scale structures and, more specifically, to planar field emitters.

2. Description of the Prior Art

Cold cathode field emission occurs when the local electric field at the surface of a conductor approaches about $10^9$V/m. In this field regime, the work function barrier is reduced enough to permit electronic tunneling from the conductor to vacuum, even at low temperatures. To achieve the high local fields at experimentally achievable macroscopic fields, field emission sources are typically made from sharp objects such as etched wires, micro-fabricated cones or nanostructured conductors such as carbon nanotubes (CNTs).For the majority of field emission applications, the cathode current needs to be controllable. In general, control is achieved with a gate located nearby the field emission source that generates the field used to eject electrons from the field emission source but only absorbs a fraction of the emitter current.

Cold cathode field emission devices have the capability to produce very high current density electron beams (greater than 100 A/cm$^2$) with low power consumption. However field emission devices have not, to date, been incorporated into commercial high current density applications such as power microwave electronics because field emission sources may fail prematurely unless extreme care is taken to protect the devices.

Typical field emission devices are variants of the conventional Spindt field emission array. This device design has several inherent vulnerabilities stemming from the small dimensions required to achieve a high enough field strength to emit electrons from a conical structure. Under ideal operating conditions (e.g. $10^{-9}$ Torr, with no perturbation in the gate voltage, gate currents or anode voltage), Spindt emitter arrays have been shown to emit in excess of 40 A/cm$^2$ for extended periods of time. In most applications however, the electron source typically encounters occasional plasma discharges, called spits. Spits are often caused by gas desorption from an anode surface that is ionized by the electron beam. The resulting plasma generates an arc between the anode and nearby surfaces at a lower potential such as the field emitter. Depending upon the cable capacitance, potential difference and embedded circuit protection, a spit has the potential to destroy field emitter devices, even if the spit does not land on the device itself. In high voltage applications, such as x-ray tubes, because spits typically draw more than 100 amps for less than 1 microsecond, the inductively and capacitively coupled currents will often destroy Spindt field emitter devices, even if the spit does not directly impact the field emission source. In addition, during the spit, the voltage on the anode often drops to a low enough value that the anode is no longer able to absorb the cathode current. Therefore, the gate electrode absorbs up to the entire cathode current. At moderate current densities in Spindt emitters, (greater than about 100 mA/cm$^2$), localized heating from the excessive gate current can destroy the device quickly.

Recently, nanostructured materials, such as carbon nanotubes, have been proposed as field emission sources. Because of their narrow diameter, high electrical conductivity and high thermal conductivity they offer the potential for field emission sources that operate at lower gate voltages compared to conical emitters. To date however, nanostructured field emission sources have not achieved current densities demonstrated in Spindt field emission source.

Therefore, there is a need for a field emission source capable of producing high current density that is more robust than conventional Spindt field emission devices.

There is also a need for a robust field emission device in which the gate current, threshold voltage and switching speed are comparable to conventional Spindt field emitter arrays.

SUMMARY OF THE INVENTION

The disadvantages of the prior art are overcome by the present invention, which, in one aspect, is a field emitter including a substrate, a conductive cathode member, a conductive gate member, and at least one emitter structure. The substrate has a substantially non-conductive top substrate surface. The conductive cathode member is disposed on the top substrate surface and has a top cathode surface. The conductive gate member is disposed on the top substrate surface and is substantially coplanar with the cathode member. The emitter structure extends away from the top cathode surface. The gate member is spaced apart from the cathode member at a distance so that when a predetermined potential is applied between the cathode member and gate member, the emitter structure will emit electrons.

In another aspect, a field emitting device includes a substantially non-conductive substrate having a top substrate surface. An elongated substantially planar cathode member is disposed on the top substrate surface and has a top cathode surface. An elongated substantially planar gate member is disposed on the top substrate surface and is spaced apart from the cathode member. The elongated substantially planar gate member is substantially coplanar with the cathode member. A plurality of carbon nanotubes extend away from the top cathode surface. The substrate defines a trench disposed between the cathode member and the gate member. The gate member is spaced apart from the cathode member at a distance so that when a predetermined potential is applied between the cathode member and gate member, the carbon nanotubes will emit electrons in a direction that is transverse to the plane of the cathode member and the gate member and away from the substrate.

In yet another aspect, the invention includes a method of making a field emitter, in which a conductive layer is deposited on a surface of a substantially non-conductive substrate. Preselected portions of the conductive layer are removed so as to form at least one cathode member and a spaced-apart gate member that is substantially co-planar with the cathode member. At least one emitter structure is grown on a portion of the cathode member.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
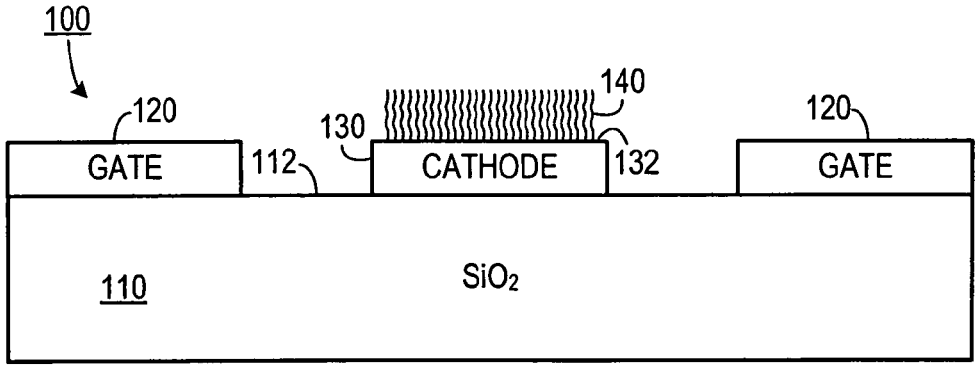
FIG. 1 is a cross-sectional schematic view of a field emitter.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in"includes "in" and "on." Unless otherwise specified herein, the drawings are not necessarily drawn to scale.

As shown in FIG. 1, one embodiment of a field emitter 100 includes a substrate 110. The substrate 110 could be made of a material that is substantially non-conductive or include a layer that makes the top substrate surface 112 non-conductive. In one embodiment, the substrate includes silicon dioxide. In another embodiment, the substrate 110 could be a single crystal of silicon with an insulating layer forming the top surface 112. A few examples of the material that forms the substrate 110 include: silicon dioxide, aluminum oxide, amorphous glass, boron nitride, silicon carbide, and combinations thereof.

A cathode member 130 is deposited on the top substrate surfaced 112 and has a top cathode surface 132. The cathode member 130 could be an elongated layer made from such materials as TiW, molybdenum, chromium, gold, platinum, and combinations thereof.

A conductive gate member 120 is also disposed on the top substrate surface 112 so as to be substantially coplanar with the cathode member 130. The gate member 120 could also be made from such materials as TiW, molybdenum, chromium, gold, platinum, and combinations thereof.

At least one emitter structure 140 extends away from the top cathode surface 132. In many embodiments, a plurality of emitter structures 140 extends from the top cathode surface 132. Suitable emitter structures include nanotubes (such as carbon nanotubes), nanorods (such as metal oxide nanorods) and nanowires. Other structures (such as conical, pyramidal, other structures with a wide base narrow extreme end) would be suitable as emitter structures, depending on the specific application.

The gate member 120 is spaced apart from the cathode member 130 at a distance so that when a predetermined potential is applied between the cathode member 130 and gate member 120, the emitter structure 140 will emit electrons.

Figure 2:
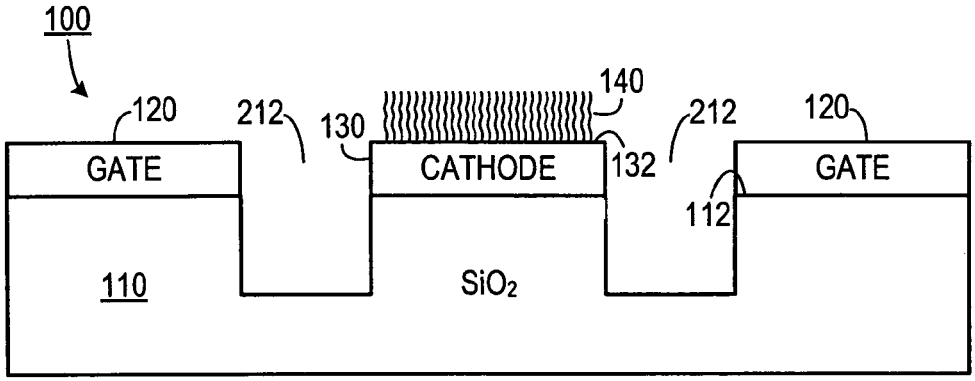
FIG. 2 is a cross-sectional schematic view of a field emitter.

As shown in FIG. 2, in one embodiment, a trench 212 can be formed between the cathode member 130 and the gate member 120. By doing so, a greater potential may be applied between the cathode member 130 and the gate member 120 without causing dielectric breakdown in the substrate 110.

Figure 3A:
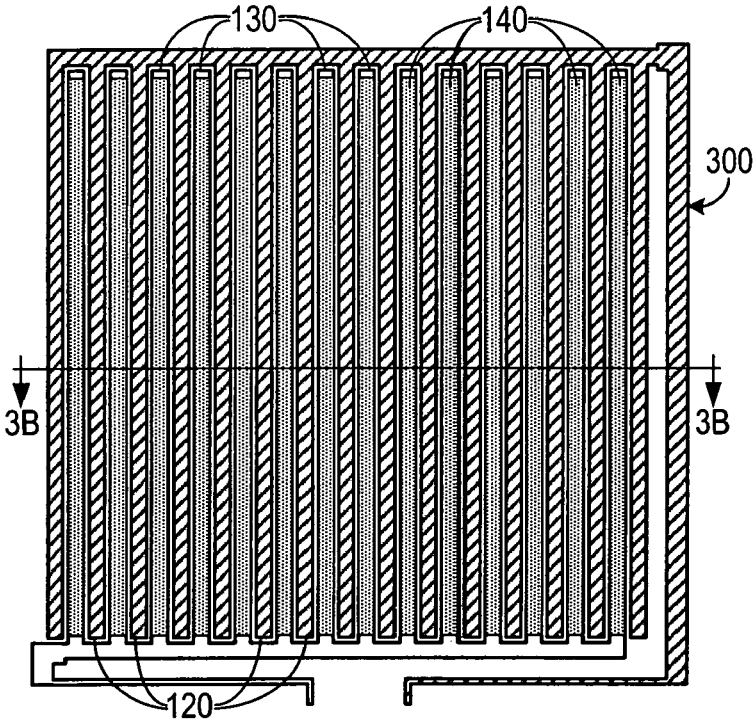
FIG. 3A is a top plan view of an array of field emitters.
Figure 3B:
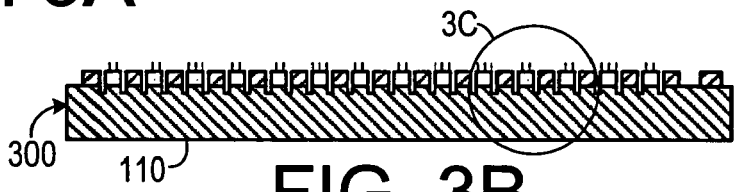
FIGS. 3B-3C are cross-sectional schematic views of the array of field emitters shown in FIG. 3A.
Figure 3C:
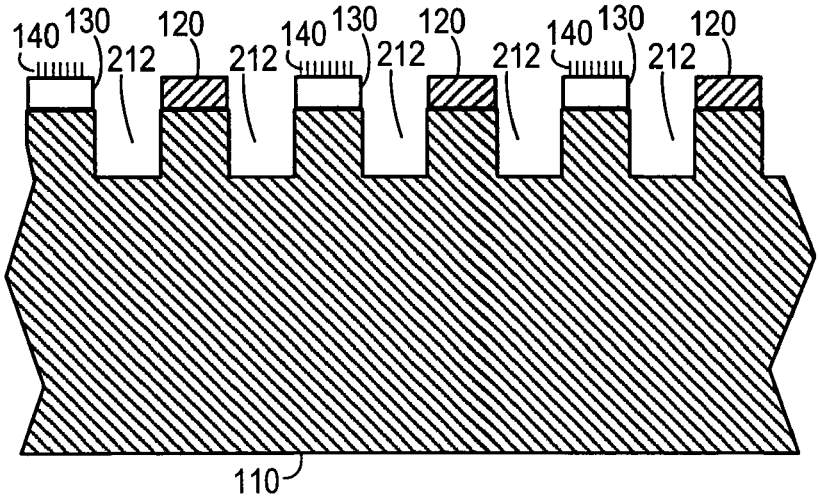

As shown in FIG. 3A, an array of field emitters 300 may be formed by alternating elongated rows of the gate member 120 and the cathode member 130, with a corresponding row of the emitter structures 140 extending upwardly from the cathode member 130 rows. A cross-sectional view of the array 300, taken along line 3B-3B, is shown in FIG. 3B, and a detail in circle 3C is shown in FIG. 3C.

While FIG. 3A shows essentially linear elongated rows, the elongated cathode members 130 and gate members 120 could be curved or even spiraled. However, it is desirable that the distance between these two structures are substantially constant.

Figure 4A:
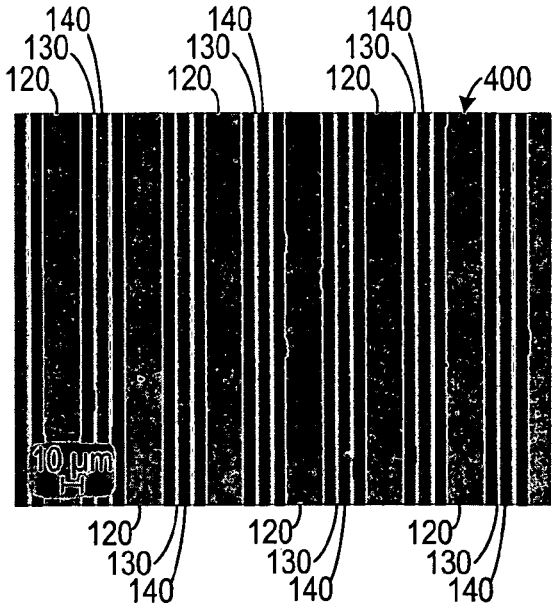
FIGS. 4A-4B are a micrographs of field emitters.
Figure 4B:
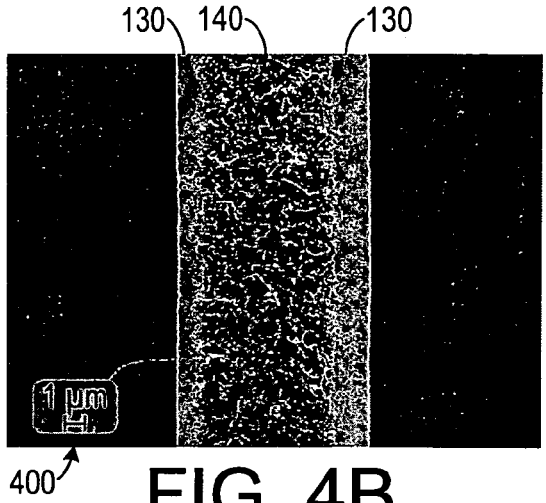

A micrograph 400 of an experimental embodiment is shown in FIGS. 4A and 4B (with FIG. 4B showing a greater magnification).

Figure 5:
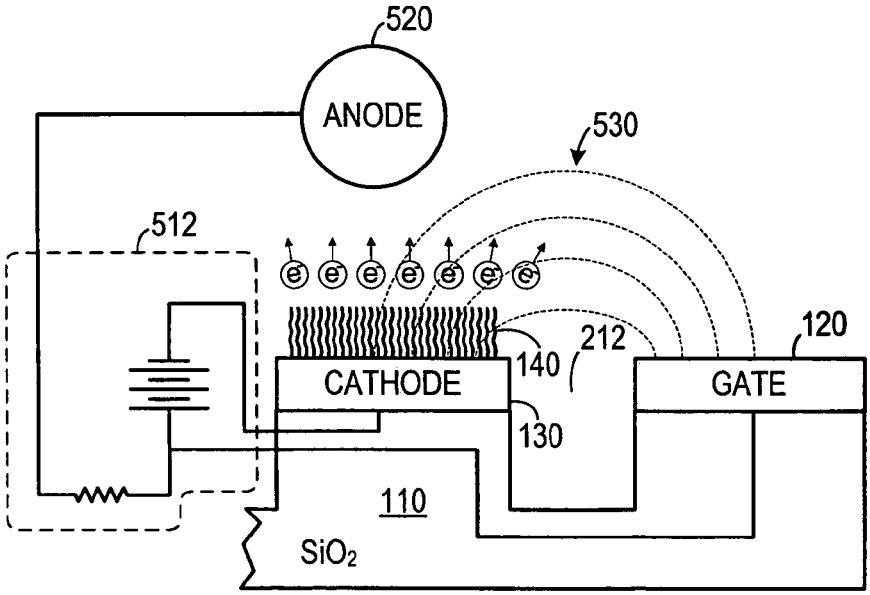
FIG. 5 is a cross-sectional schematic view of a field emitter and an anode.

An anode 520 may be added, as shown in FIG. 5, for display and switching applications. A circuit 512 may be used to apply a potential between the cathode member 130 and the gate member 120. When an anode 520 is used, the electric field (as represented by force lines 530) between the gate member 120 and the cathode member 130 liberate electrons from the emitter structures 140. However, once emitted, the momentum of the electrons allows them to be captured by the anode 520.

Figure 6A:
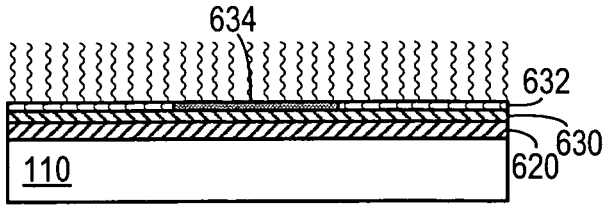
FIGS. 6A-6H is a series of schematic diagrams showing one illustrative method of making a field emitter.
Figure 6B:
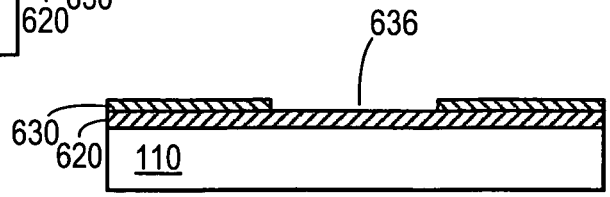

One method of making field emitters is shown in FIGS. 6A-6H and uses a photo-lithographic process generally known to the electronic arts. As shown in FIG. 6A, a conductive film 620 is deposited onto a substrate 110 and a layer of photo-resist 630 is applied to the conductive film 620. A mask 632 with an opaque region, corresponding to the area of the conductive film 620 that is to be removed, is applied to the photo-resist layer 630 and the mask is exposed to radiation that causes the photo-resist 630 to harden. As shown in FIG. 6B, the photo-resist layer 630 is developed, which causes photo-resist to be removed in the region under the opaque area 634 of the mask 632, leaving an exposed area 636.

Figure 6C:
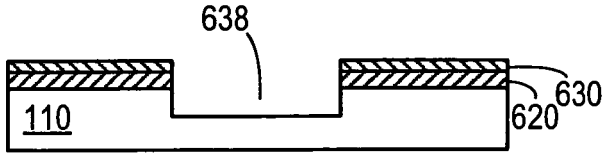
Figure 6D:
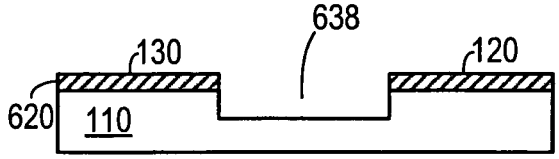

As shown in FIG. 6C, a trench 638 is etched into the conductive film 620 and the substrate 110 and, as shown in FIG. 6D, the photo-resist layer 630 is removed to leave the cathode member 130 and the gate member 120.

Figure 6E:
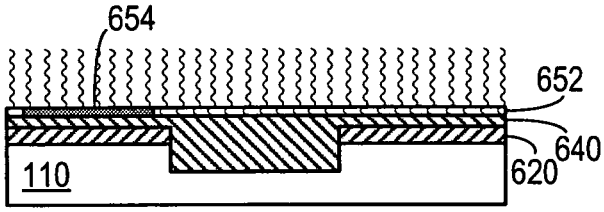
Figure 6F:
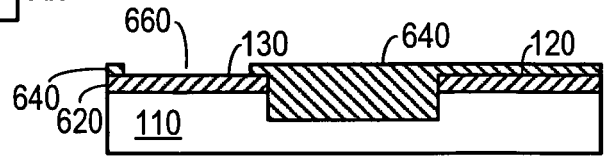
Figure 6G:
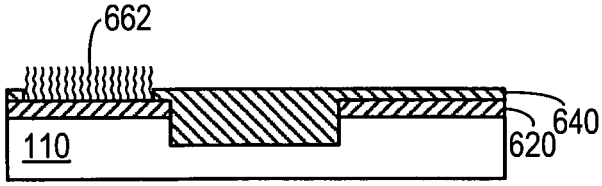
Figure 6H:
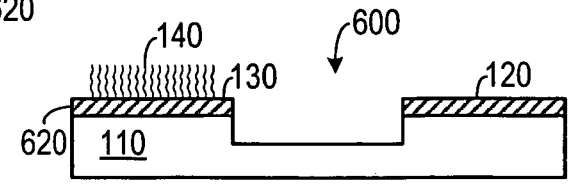

As shown in FIG 6E, another layer of photo-resist 640 is applied and a mask 652 having an opaque area 654 corresponding to the area of the emitter structures is applied and exposed. As shown in FIG. 6F, the photo-resist 640 is developed, leaving a portion 660 of the cathode member 130 exposed. As shown in FIG. 6G, the emitter structures 662. are grown in the exposed portion using a known method of growing the emitter structures 662. In one example, a plurality of catalyst particles (such as iron) are deposited in the exposed portion 660, which are then exposed to a carbon-rich gas feedstock (e.g., carbon monoxide, methane or ethylene) at a suitable temperature (e.g., 700-1000°C) and pressure, thereby growing carbon nanotubes. Decomposition of the feed gas occurs only at the catalyst sites, reducing amorphous carbon generated in the process. Decomposed carbon molecules then assemble into nanotubes at the catalyst nanoparticle sites. In another example, chemical vapor deposition may be used to grow metal oxide nanorods. Finally, as shown in FIG. 6H, all remaining photo-resist is removed, leaving a field emitter 600.

Generally, field emitters as disclosed herein may not be able to support as high of a local electrical field as conventional field emitters, however the sharp tips of the emitter structures 140 of the disclosed invention increases the local electric field that results in electrons being emitted at a lower gate voltage.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A field emitter, comprising:

a. a substrate having a substantially non-conductive surface;

b. a conductive cathode member, disposed on the top substrate surface, the cathode member having a top cathode surface;

c. c. a conductive gate member, disposed on the top substrate surface and substantially coplanar with the cathode member; and d. at least one emitter structure extending away from the top cathode surface, the gate member spaced apart from the cathode member at a distance so that when a predetermined potential is applied between the cathode member and gate member, the emitter structure will emit electrons;

wherein the substrate defines an unfilled trench disposed between the cathode member and the gate member, and wherein the gate member is not disposed within the trench.

2. The field emitter of claim 1, wherein the substrate comprises a material selected from a group consisting essentially of silicon dioxide, aluminum oxide, amorphous glass, boron nitride, silicon carbide, and combinations thereof.

3. The field emitter of claim 1, wherein the cathode member comprises an elongated layer including a material selected from a group consisting essentially of: TiW, molybdenum, chromium, gold, platinum, and combinations thereof.

4. The field emitter of claim 1, wherein the gate member comprises an elongated layer including TiW, molybdenum, chromium, gold, platinum, and combinations thereof.

5. The field emitter of claim 1, wherein the emitter structure comprises a nanostructure.

6. The field emitter of claim 5, wherein the nanostructure comprises a nanotube.

7. The field emitter of claim 6, wherein the nanotube comprises a carbon nanotube.

8. The field emitter of claim 5, wherein the nanostructure comprises a nanorod.

9. The field emitter of claim 1, further comprising an anode member spaced apart from the cathode member.

10. A field emitting device, comprising:

a. a substantially non-conductive substrate having a top substrate surface;

b. an elongated substantially planar cathode member, disposed on the top substrate surface, the cathode member having a top cathode surface;

c. an elongated substantially planar gate member, disposed on the top substrate surface, spaced apart from the cathode member and substantially coplanar with the cathode member; and d. a plurality of carbon nanotubes extending away from the top cathode surface, the substrate defining an unfilled trench disposed between the cathode member and the gate member wherein the gate member is not disposed within the trench, the gate member spaced apart from the cathode member at a distance so that when a predetermined potential is applied between the cathode member and gate member, the carbon nanotubes will emit electrons in a direction that is transverse to the plane of the cathode member and the gate member and away from the substrate.

11. The field emitter of claim 10, wherein the substrate comprises a material selected from a group consisting essentially of silicon dioxide, aluminum oxide, amorphous glass, boron nitride, silicon carbide, and combinations thereof.

12. The field emitter of claim 10, wherein the cathode member comprises an elongated layer including a material selected from a group consisting essentially of: TiW, molybdenum, chromium, gold, platinum, and combinations thereof.

13. The field emitter of claim 10, wherein the gate member comprises an elongated layer including TiW, molybdenum, chromium, gold, platinum, and combinations thereof.

14. The field emitter of claim 10, further comprising an anode member spaced apart from the cathode member and substantially parallel with the non-conductive substrate.

* * * * *

UNITED STATES PATENT AND TRADEMARK OFFICE

CERTIFICATE OF CORRECTION

PATENT NO. : 7,508,122 B2
APPLICATION NO. : 11/029707
DATED : March 24, 2009
INVENTOR(S) : Huber It is certified that error appears in the above-identified patent and that said Letters Patent is hereby corrected as shown below:

In Column 5, Line 4, in Claim 1, delete “c.”, before “a conductive”.

Signed and Sealed this

Second Day of June, 2009

JOHN DOLL
*Acting Director of the United States Patent and Trademark Office*